US009124010B2

(12) United States Patent
Eriksen et al.

(10) Patent No.: US 9,124,010 B2
(45) Date of Patent: Sep. 1, 2015

(54) COAXIAL CABLE CONNECTOR FOR SECURING CABLE BY AXIAL COMPRESSION

(71) Applicant: John Mezzalingua Associates, Inc., East Syracuse, NY (US)

(72) Inventors: Kim Lundgren Eriksen, Tappernoeje (DK); Christian Stoltze, Bagsvaerd (DK)

(73) Assignee: PPC Broadband, Inc., East Syracuse, NY (US)

( * ) Notice: Subject to any disclaimer, the term of this patent is extended or adjusted under 35 U.S.C. 154(b) by 41 days.

(21) Appl. No.: 13/687,052

(22) Filed: Nov. 28, 2012

(65) Prior Publication Data

US 2013/0137300 A1 May 30, 2013

Related U.S. Application Data

(60) Provisional application No. 61/565,158, filed on Nov. 30, 2011.

(51) Int. Cl.

| | |
|---|---|
| ***H01R 9/05*** | (2006.01) |
| *H01R 103/00* | (2006.01) |
| *H01R 43/20* | (2006.01) |

(52) U.S. Cl.

CPC ..... *H01R 9/0524* (2013.01); *H01R 43/20* (2013.01); *H01R 2103/00* (2013.01)

(58) Field of Classification Search

CPC ..... H01R 9/0521
USPC ..... 439/578, 83, 584, 583, 585
See application file for complete search history.

(56) References Cited

U.S. PATENT DOCUMENTS

| | | | | | |
|---|---|---|---|---|---|
| 3,292,136 | A | * | 12/1966 | Somerset | 439/584 |
| 4,117,711 | A | | 10/1978 | Medcraft | |
| 4,676,577 | A | | 6/1987 | Szegda | |
| 5,011,432 | A | | 4/1991 | Sucht et al. | |
| 5,181,272 | A | | 1/1993 | Hopper | |
| 5,271,080 | A | | 12/1993 | Hopper | |
| 5,392,508 | A | | 2/1995 | Holliday | |
| 5,435,745 | A | | 7/1995 | Booth | |
| 5,548,088 | A | | 8/1996 | Gray et al. | |
| 5,596,800 | A | | 1/1997 | Holliday | |

(Continued)

FOREIGN PATENT DOCUMENTS

| | | | |
|---|---|---|---|
| EP | 2451013 | A1 | 5/2012 |
| WO | WO/2005/029147 | A1 | 3/2005 |

(Continued)

*Primary Examiner* — Neil Abrams
(74) *Attorney, Agent, or Firm* — Barclay Damon, LLP

(57) ABSTRACT

A coaxial cable connector including a connector body having a forward end, a rearward end, and a hollow cavity adjacent the forward end, the hollow cavity having an inward facing lip, a first insulator configured to fit within the hollow cavity in such a way that the inward facing lip resists removal of the first insulator from the hollow cavity, the first insulator having a central hole, a center conductor contact having a socket end and a pin end, the socket end located within the connector body toward the rearward end, the pin end passing through the central hole of the first insulator, a spring contact configured to fit into the socket end of the center conductor contact, and a second insulator having a central passageway, the second insulator having a first end and a second end, the first end adjacent the socket end of the center conductor contact.

24 Claims, 10 Drawing Sheets

(56) References Cited

U.S. PATENT DOCUMENTS

| | | | | |
|---|---|---|---|---|
| 5,620,339 | A | 4/1997 | Gray et al. | |
| 5,651,698 | A | 7/1997 | Locati et al. | |
| 5,868,584 | A | 2/1999 | Cook | |
| 6,027,373 | A | 2/2000 | Gray et al. | |
| 6,089,903 | A | 7/2000 | Stafford Gray et al. | |
| 6,089,913 | A | 7/2000 | Holliday | |
| 6,116,069 | A | 9/2000 | Holliday | |
| 6,146,196 | A | 11/2000 | Burger et al. | |
| 6,183,298 | B1 | 2/2001 | Henningsen | |
| 6,352,448 | B1 * | 3/2002 | Holliday et al. | 439/585 |
| 6,716,062 | B1 | 4/2004 | Palinkas | |
| 6,802,738 | B1 | 10/2004 | Henningsen | |
| 6,884,113 | B1 | 4/2005 | Montena | |
| 7,309,255 | B2 * | 12/2007 | Rodrigues | 439/578 |
| 7,326,079 | B2 | 2/2008 | Holliday | |
| 7,513,796 | B2 | 4/2009 | Amidon | |
| 7,527,524 | B1 * | 5/2009 | Coleman et al. | 439/578 |
| 7,566,236 | B2 | 7/2009 | Malloy | |
| 7,588,460 | B2 * | 9/2009 | Malloy et al. | 439/578 |
| 7,645,161 | B2 * | 1/2010 | Holliday | 439/578 |
| 7,645,163 | B2 | 1/2010 | Amidon | |
| 7,699,533 | B2 | 4/2010 | Milette | |
| 7,811,006 | B2 | 10/2010 | Milette | |
| 7,862,367 | B2 | 1/2011 | Amidon | |
| 7,892,014 | B2 | 2/2011 | Amidon | |
| 8,007,314 | B2 * | 8/2011 | Chawgo et al. | 439/548 |
| 8,016,615 | B2 | 9/2011 | Montena | |
| 8,029,315 | B2 | 10/2011 | Purdy | |
| 8,038,472 | B2 | 10/2011 | Montena | |
| 8,708,737 | B2 * | 4/2014 | Chawgo et al. | 439/578 |
| 2004/0077215 | A1 | 4/2004 | Palinkas | |
| 2004/0110418 | A1 | 6/2004 | Holliday et al. | |
| 2005/0085125 | A1 | 4/2005 | Montena | |
| 2005/0117850 | A1 | 6/2005 | Milette | |
| 2006/0189188 | A1 | 8/2006 | Holliday | |
| 2007/0298654 | A1 | 12/2007 | Holliday | |
| 2008/0013890 | A1 | 1/2008 | Milette | |
| 2008/0171467 | A1 | 7/2008 | Amidon | |
| 2008/0182451 | A1 | 7/2008 | Amidon | |
| 2008/0311790 | A1 | 12/2008 | Malloy | |
| 2009/0053929 | A1 | 2/2009 | Burris et al. | |
| 2009/0075513 | A1 | 3/2009 | Amidon | |
| 2009/0197465 | A1 | 8/2009 | Montena | |
| 2009/0239405 | A1 | 9/2009 | Amidon | |
| 2009/0239406 | A1 | 9/2009 | Amidon | |
| 2009/0317037 | A1 | 12/2009 | Milette | |
| 2010/0046892 | A1 | 2/2010 | Milette | |
| 2010/0054670 | A1 | 3/2010 | Milette | |
| 2010/0081321 | A1 | 4/2010 | Malloy | |
| 2010/0081322 | A1 | 4/2010 | Malloy | |
| 2010/0170090 | A1 | 7/2010 | Rodrigues | |
| 2010/0255721 | A1 | 10/2010 | Purdy | |
| 2010/0261381 | A1 | 10/2010 | Montena | |
| 2010/0261382 | A1 | 10/2010 | Montena | |
| 2010/0267271 | A1 | 10/2010 | Amidon | |
| 2010/0273344 | A1 | 10/2010 | Amidon | |
| 2011/0059649 | A1 | 3/2011 | Montena | |
| 2011/0117774 | A1 | 5/2011 | Malloy | |
| 2013/0137300 | A1 * | 5/2013 | Eriksen et al. | 439/583 |

FOREIGN PATENT DOCUMENTS

| | | | |
|---|---|---|---|
| WO | WO/2005/041359 | A1 | 5/2005 |
| WO | WO/2008/03387 | A1 | 3/2008 |
| WO | WO/2010/020048 | A1 | 2/2010 |
| WO | WO/2010/114974 | A2 | 10/2010 |
| WO | WO/2010/117890 | A2 | 10/2010 |
| WO | WO/2010/141647 | A2 | 12/2010 |
| WO | WO/2010/141649 | A2 | 12/2010 |

* cited by examiner

COAXIAL CABLE CONNECTOR FOR SECURING CABLE BY AXIAL COMPRESSION

CROSS REFERENCE TO RELATED APPLICATIONS

This application claims the benefit of U.S. Provisional Application No. 61/565,158, filed Nov. 30, 2011, entitled COAXIAL CABLE CONNECTOR FOR SECURING CABLE BY AXIAL COMPRESSION.

FIELD OF TECHNOLOGY

The following relates to a coaxial cable connector, and more specifically to embodiments of a coaxial cable connector for guiding a center conductor of a coaxial cable into the coaxial cable connector prior to securing the coaxial cable by axial compression.

BACKGROUND

Coaxial cable connectors are used to convey radio frequency (RF) signals in various applications. Coaxial cable connectors typically include a connector body, a coaxial cable attachment end, and an interface end. The coaxial cable connector is typically configured for attachment to a coaxial cable and connection to a standard interface, such as an F-type port or an IEC receptacle. Coaxial cables exist in which the center conductor is easily damaged during installation onto a coaxial cable connector. It is often difficult to determine whether a coaxial cable is fully inserted into the coaxial cable connector.

Thus, a need exists for a coaxial cable connector apparatus and method for protecting the center conductor during installation and providing a visible indication that the coaxial cable is fully inserted into the coaxial cable connector.

SUMMARY

A first aspect of this disclosure includes a coaxial cable connector including a connector body having a forward end, a rearward end, and a hollow cavity adjacent the forward end, the hollow cavity being a recessed region defined by an inward facing lip, a first insulator configured to fit within the hollow cavity in such a way that the inward facing lip resists removal of the first insulator from the hollow cavity, the first insulator having a central hole, a center conductor contact having a socket end and a pin end, the socket end located within the connector body toward the rearward end, the pin end passing through the central hole of the first insulator, a spring contact having one or more spring fingers, the spring contact configured to fit into the socket end of the center conductor contact, and a second insulator having a central passageway configured to receive a center conductor of a coaxial cable, the second insulator having a first end and a second end, the first end adjacent the socket end of the center conductor contact, wherein an axial force applied to the second end of the second insulator drives the center conductor contact axially forward to contact the first insulator such that the axial force further drives the first insulator toward the forward end of the connector body.

A second aspect of this disclosure includes a coaxial cable connector includes a connector body having a forward end, a rearward end, and a hollow cavity adjacent the forward end, the rearward end configured for radially inward movement, the connector body having a longitudinal axis, a compression cap configured to fit over the rearward end of the connector body, the compression cap having an internal bore configured to cause radially inward movement of the rearward end of the connector body upon axial advancement of the compression cap over the rearward end, a first insulator configured to fit within the hollow cavity of the connector body, the first insulator having a central hole, and a center conductor contact having a socket end and a pin end, the socket end located within the connector body toward the rearward end, the socket end configured to receive a center conductor of a coaxial cable, the pin end passing through the central hole of the first insulator, the center conductor contact having a common longitudinal axis with the connector body, wherein the radial movement of the rearward end caused by axial advancement of the compression cap applies radial force to the coaxial cable jacket and the shield end of the coaxial cable, securing the coaxial cable to the compression connector A third aspect of this disclosure includes a method of assembling a coaxial cable connector for a coaxial cable, the coaxial cable having a center conductor surrounded by a dielectric, the dielectric surrounded by a conductive grounding shield, the conductive grounding shield surrounded by a protective outer jacket, the method including inserting a first insulator into a connector body, the connector body having a forward end, a rearward end, and a hollow cavity adjacent the forward end, the hollow cavity being a recessed region defined by an inward facing lip, the first insulator configured to fit within the hollow cavity in such a way that the inward facing lip resists removal of the first insulator from the hollow cavity, the first insulator having a central hole, inserting a center conductor contact into the first insulator, the center conductor contact having a socket end and a pin end, the socket end placed within the connector body toward the rearward end, and the pin end passing through the central hole of the first insulator, inserting a spring contact into the center conductor contact, the spring contact having one or more spring fingers, the spring contact configured to fit into the socket end of the center conductor contact, and attaching a second insulator to the center conductor contact, the second insulator having a central passageway configured to receive a center conductor of a coaxial cable, the second insulator having a first end and a second end, the first end adjacent the socket end of the center conductor contact.

BRIEF DESCRIPTION OF THE DRAWINGS

Some of the embodiments will be described in detail, with reference to the following figures, wherein like designations denote like members, wherein.

DETAILED DESCRIPTION

Figure 1:
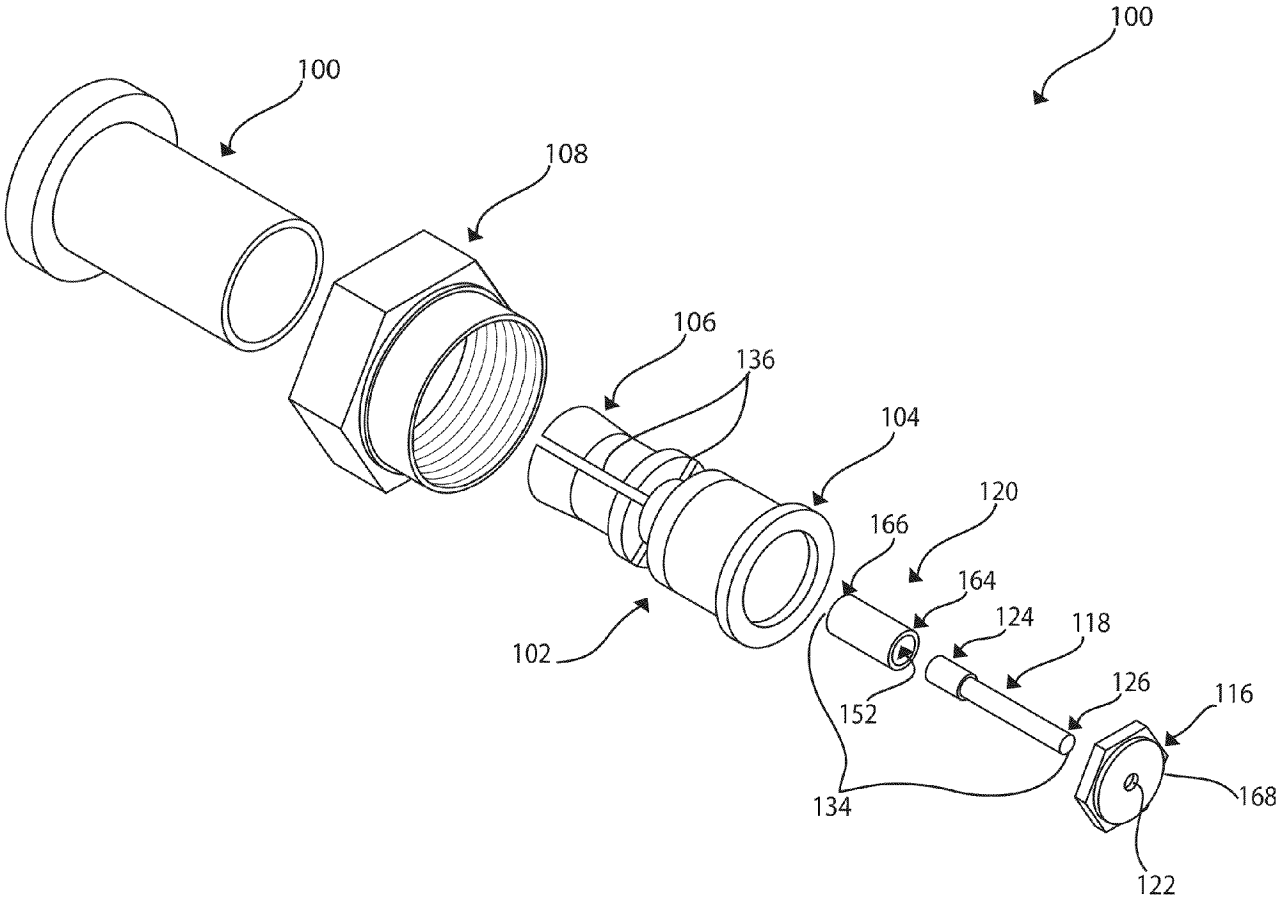
FIG. 1 depicts an exploded perspective view of an embodiment of a coaxial cable connector.
Figure 2:
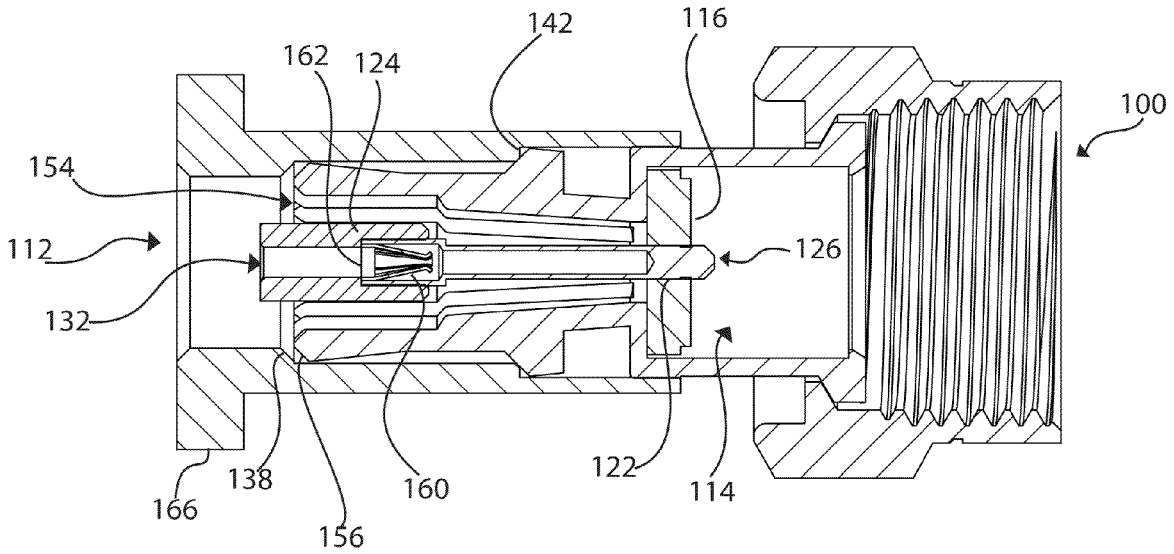
FIG. 2 depicts a hatched cross-sectional side elevation view of the coaxial cable connector of FIG. 1.
Figure 3:
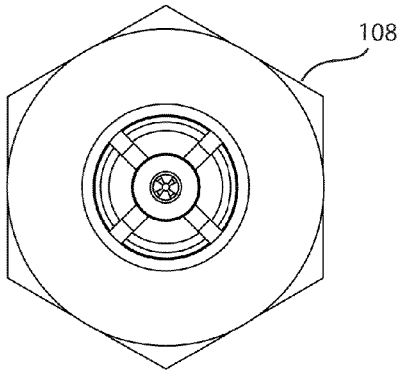
FIG. 3 depicts a rear elevation view of the coaxial cable connector of FIG. 2.
Figure 4:
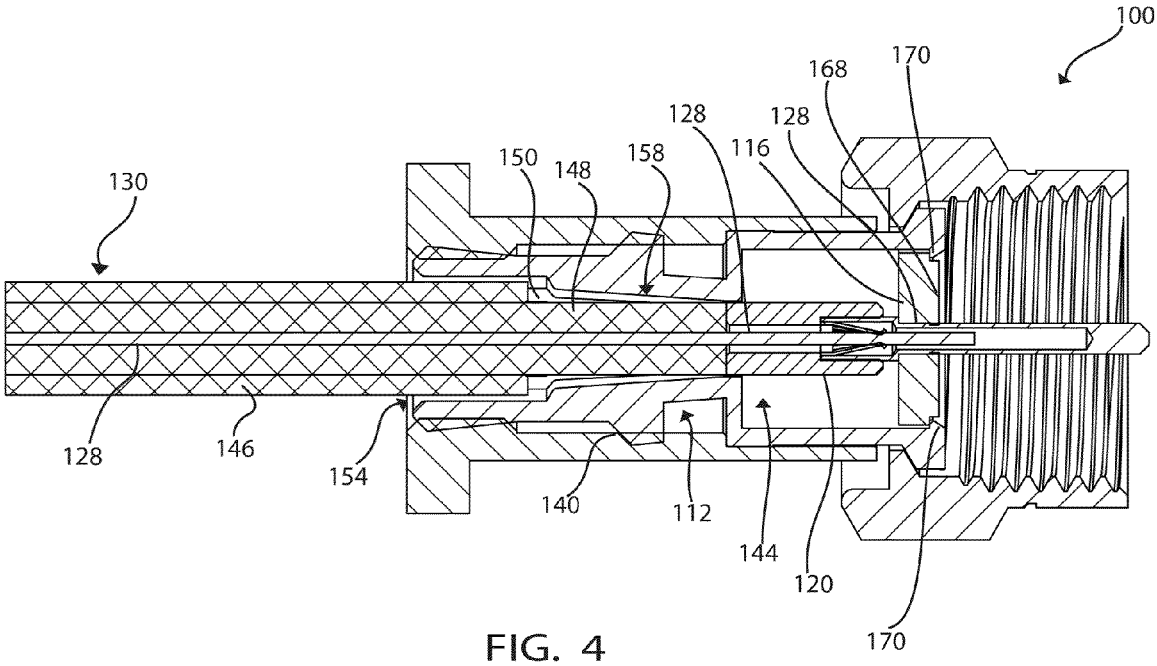
FIG. 4 depicts a hatched cross-sectional side elevation view of the coaxial cable connector of FIG. 1 having a coaxial cable inserted and the compression cap in a compressed state.
Figure 5:
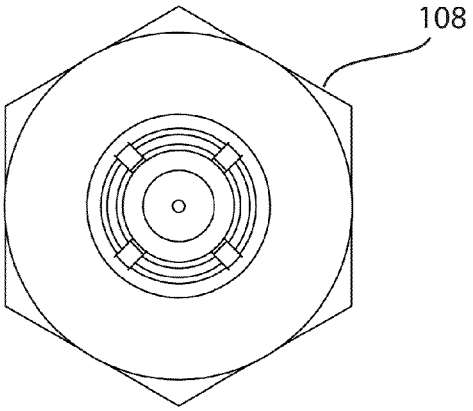
FIG. 5 depicts a rear elevation view of the coaxial cable connector of FIG. 4.

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure. The figures, in some cases, show overlapping components in assembly. The overlap is illustrative of an interference fit in which the components flex or otherwise accommodate the assembly of the components.

As a preface to the detailed description, it should be noted that, as used in this specification and the appended claims, the singular forms "a", "an" and "the" include plural referents, unless the context clearly dictates otherwise.

Referring to the drawings, FIGS. 1-5 depict various views of an embodiment of a coaxial cable connector 100. The coaxial cable connector 100 includes a connector body 102 having a forward end 104, a rearward end 106, and a hollow cavity 114. The forward end 104 may be configured to receive an interface component, such as an F-type nut 108 as shown in the figures, or an IEC interface for coaxial cable. In the illustrated embodiment, the forward end 104 includes a flange on which the F-type nut 108 is rotatably attached to the connector body 102. The forward end 104 may be configured differently to receive, rotatably or otherwise, alternative coaxial cable interfaces. The rearward end 106 is configured for radially inward movement. The radially inward movement may be achieved in one embodiment by one or more axial slots 136. The axial slots 136 create flexible regions that flex inward in the presence of a radially inward force. In other embodiments, the radial inward movement is achieved by selection of flexible material for the rearward end 106 and/or introduction of geometry which tends to crush or flex radially when compressed. The hollow cavity 114 is configured as a recessed region adjacent the forward end 104 of the connector body 102.

The coaxial cable connector 100 further includes a compression cap 110 configured to fit over the rearward end 106 of the connector body 102. The compression cap 110 may vary in cross-section and outward appearance depending on the manufacturing method and material used. In the illustrated embodiment, the compression cap 110 is brass or other machineable material. The compression cap 310, shown in later figures, includes a second flange end 364. Another embodiment of the compression cap 410, also shown in later figures, is designed with a more uniform wall thickness for manufacturing as an injection molded component. The compression cap 110 includes an internal bore 112 configured to cause radially inward movement of the rearward end 106 of the connector body 102 upon axial advancement of the compression cap 110 over the rearward end 106 of the connector body. The radially inward movement, or radial movement, of the rearward end 106 applies a radial force to grasp the coaxial cable 130 to attach the coaxial cable connector 100 to the coaxial cable 130. The rearward end 106 may include one or more axial slots 136 to create a flexible region. The flexible region flexes inward under the radial force applied by the compression cap 110 to grasp the coaxial cable 130. The compression cap 110 includes a first flange end 166. The first flange end 166 provides a substantial surface for applying axial force to advance the compression cap 110 axially over the rearward end 106.

The radial inward movement is achieved in one embodiment by an inward ramp 138 located inside the internal bore 112 of the compression cap 110 and cooperating with an outward ramp 156 on the rearward end 106 of the connector body 102. In another embodiment, the radial inward movement is achieved by a compression shoulder 142 located inside the internal bore 112 of the compression cap 110 that cooperates with an outward ramp 140 at a location central to the connector body 102. In various other embodiments, there are one or more inward ramps 138 and/or compression shoulders 142 cooperating with one or more outward ramps 140, 156 and/or body shoulders (not shown) located along the internal bore 112 and the outer surface of the connector body 102 forcing the rearward end 106 to move radially inward.

The coaxial cable connector 100 further includes a first insulator 116, a center conductor contact 118, and a second insulator 120. The first insulator 116 is configured to fit within the hollow cavity 114 of the connector body 102. In the illustrated embodiment, the first insulator 116 is a hex-shaped disc. The points of the hex contact the surface of the hollow cavity 114. The first insulator 116 also includes a protrusion 168 on one side. The hollow cavity 114 includes an inward facing lip 170 defining the edge of an opening, or recessed region. The inward facing lip 170 provides for the protrusion 168 to pass through the opening while stopping the first insulator 116 from passing. The protrusion 168 is shown as having a cylindrical shape, but it may be any variety of shapes, so long as it fits into the opening at the forward end 104 of the connector body 102. The first insulator 116 has a central hole 122. The center conductor contact 118 includes a socket end 124 and a pin end 126. The socket end 124 may be a cylindrical feature having a centrally located opening. The socket end 124 is configured to receive a center conductor 128 of a coaxial cable 130. The socket end 124 is located within the connector body 102 toward the rearward end 106. The pin end 126 passes through the central hole 122 of the first insulator 116.

In order to install the coaxial cable 130 into the coaxial cable connector 100, the coaxial cable 130 is prepared such that the end 144 of the coaxial cable 130 has the jacket 146, the braid and/or foil layer 150, or shield, and the dielectric 148 are removed, leaving only the center conductor 128. Another portion, the shield end 158, of the end 144 of the coaxial cable 130 is prepared by removing the jacket 146, leaving the braid and/or foil layer 150, the dielectric 148, and the center conductor 128.

The second insulator 120 is configured to receive the exposed center conductor 128 at the end 144 of a coaxial cable 130. The second insulator 120 includes a central passageway 132, a first end 164, and a second end 166. The central passageway 132 is configured for attachment to the socket end 124 of the center conductor contact 118. In one embodiment, the first end 164 includes a blind bore 152 sized to receive the socket end 124 in a press-fit relationship. In various other embodiments, the socket end 124 is attached to the first end 164 of the second insulator 120 by an adhesive or by a snap-fit arrangement or other means for attachment. In the illustrations, the second insulator 120 includes a slight lead-in shown as an angled outer corner at the opening of the blind bore 152. During installation of the coaxial cable 130 to the coaxial cable connector 100, the center conductor 148 may be guided toward the socket end 124 of the center conductor contact 118 through the central passageway 132 from the second end 166 of the second insulator 120 toward the first end 164.

The socket end 124 of the center conductor contact 118 includes a spring contact 162. The spring contact 162 has one or more spring fingers 160. The spring fingers 160 extend into the socket end 124 with an inward taper such that insertion of the center conductor 128 into the socket end 124 causes the spring fingers 160 to flex outward creating a contact force onto the center conductor 128.

The rearward end 106 of the connector body 102 defines a clamping cavity 154. The clamping cavity 154 is tapered to receive the prepared end 144 of the coaxial cable 130 as well as the full sized coaxial cable 130. In the illustrated embodiment, the second insulator 120 is the same diameter as the shield end 158 of the coaxial cable 130 having the jacket 146 removed. This configuration allows for uniform contact along the coaxial cable 130 to second insulator 120 junction, but the two elements 144, 120 do not have to line up in this way. Insertion of the coaxial cable 130 applies an axial force to the second insulator 120 to drive an assembly 134 of the second insulator 120 and the center conductor contact 118 forward to contact the first insulator 116 driving the assembly 134 and the first insulator 116 toward the forward end 104 of the connector body 102. The visible seating of the first insulator 116 at the forward end 104 of the connector body 102 indicates that the coaxial cable 130 is fully inserted. Upon full insertion, the center conductor 148 is driven to a stop position 168. The stop position 168 is when the first insulator 116 presses against the inward facing lip 170 in the hollow cavity 114. When the coaxial cable 130 is fully inserted, the compression cap 110 may be axially advanced toward the forward end 104 such that the rearward end 106 of the connector body 102 applies a radial force to the jacket 146 and the shield end 158. In that way, the coaxial cable 130 is attached to the compression connector 100.

Figure 6:
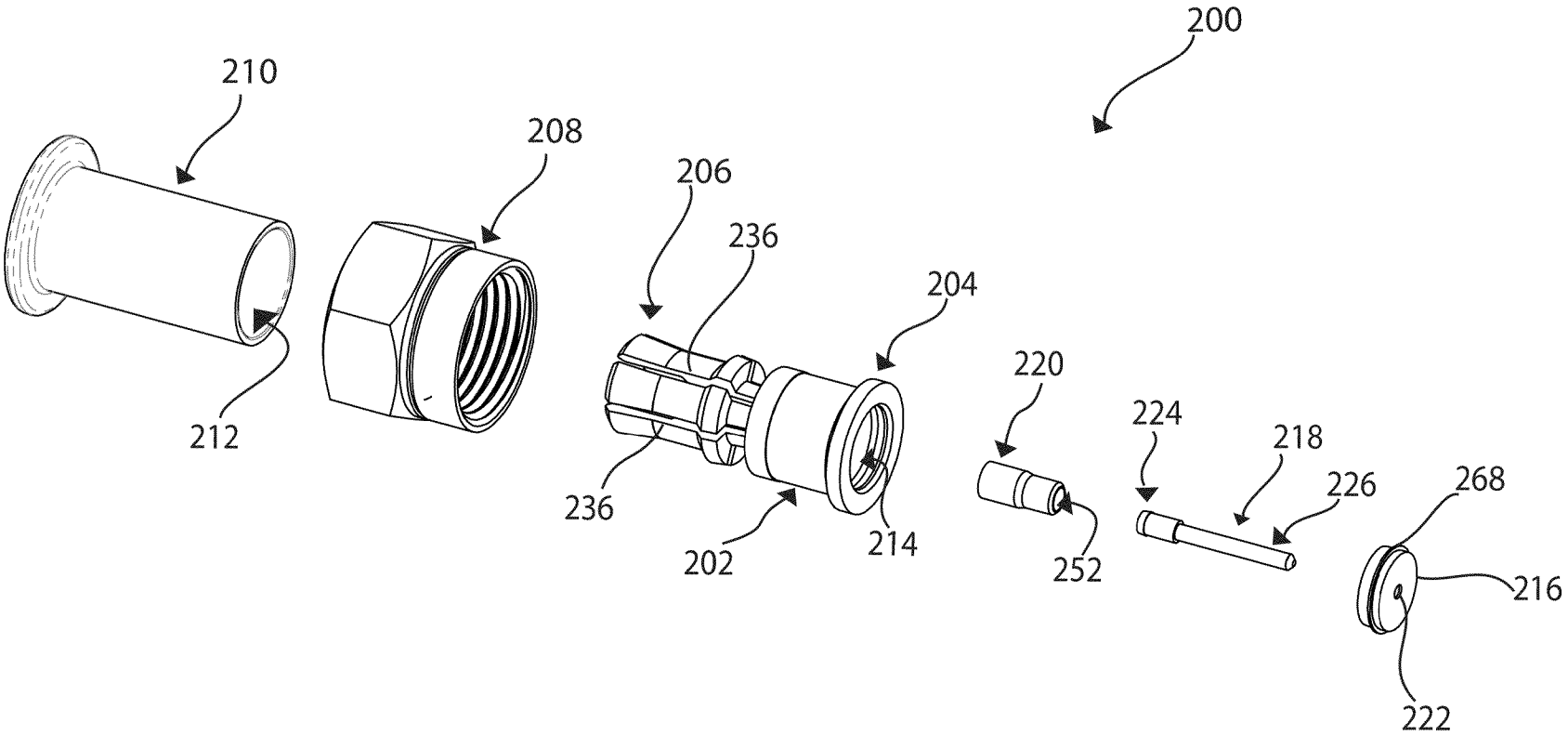
FIG. 6 depicts an exploded perspective view of an embodiment of a coaxial cable connector.
Figure 7:
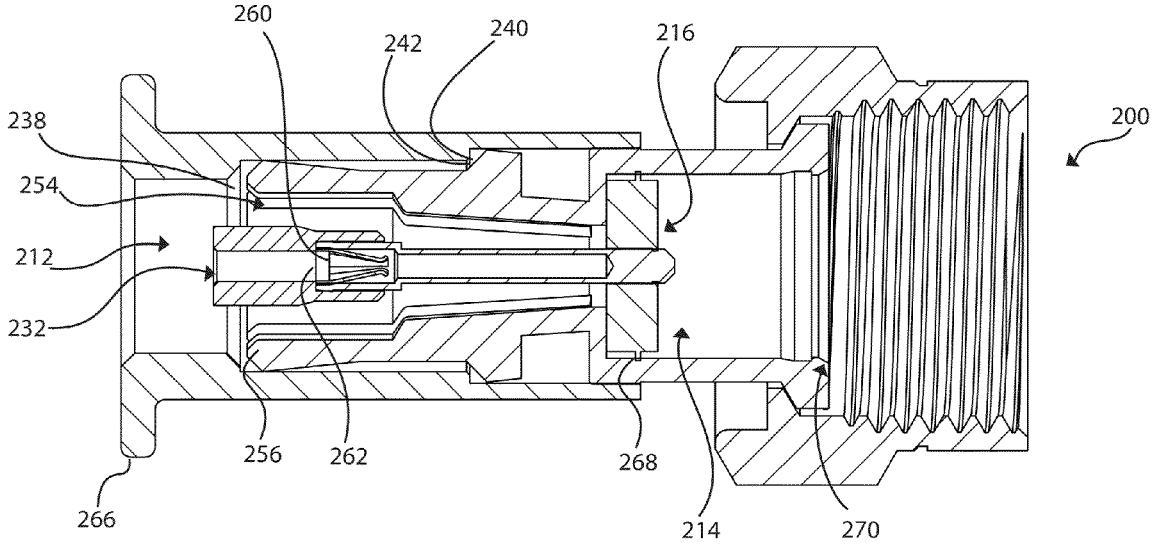
FIG. 7 depicts a hatched cross-sectional side elevation view of the coaxial cable connector of FIG. 6.
Figure 8:
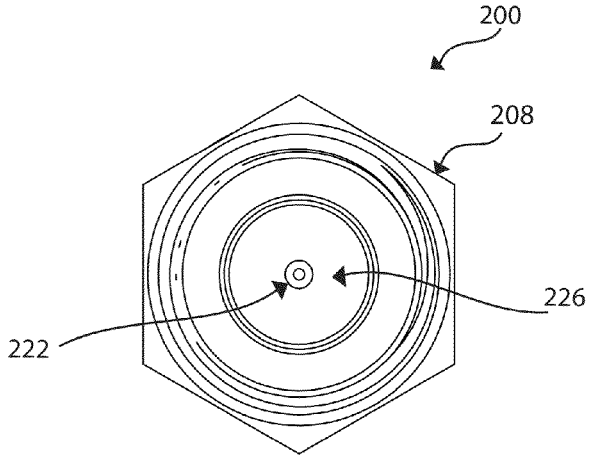
FIG. 8 depicts a front elevation view of the coaxial cable connector of FIG. 7.
Figure 9:
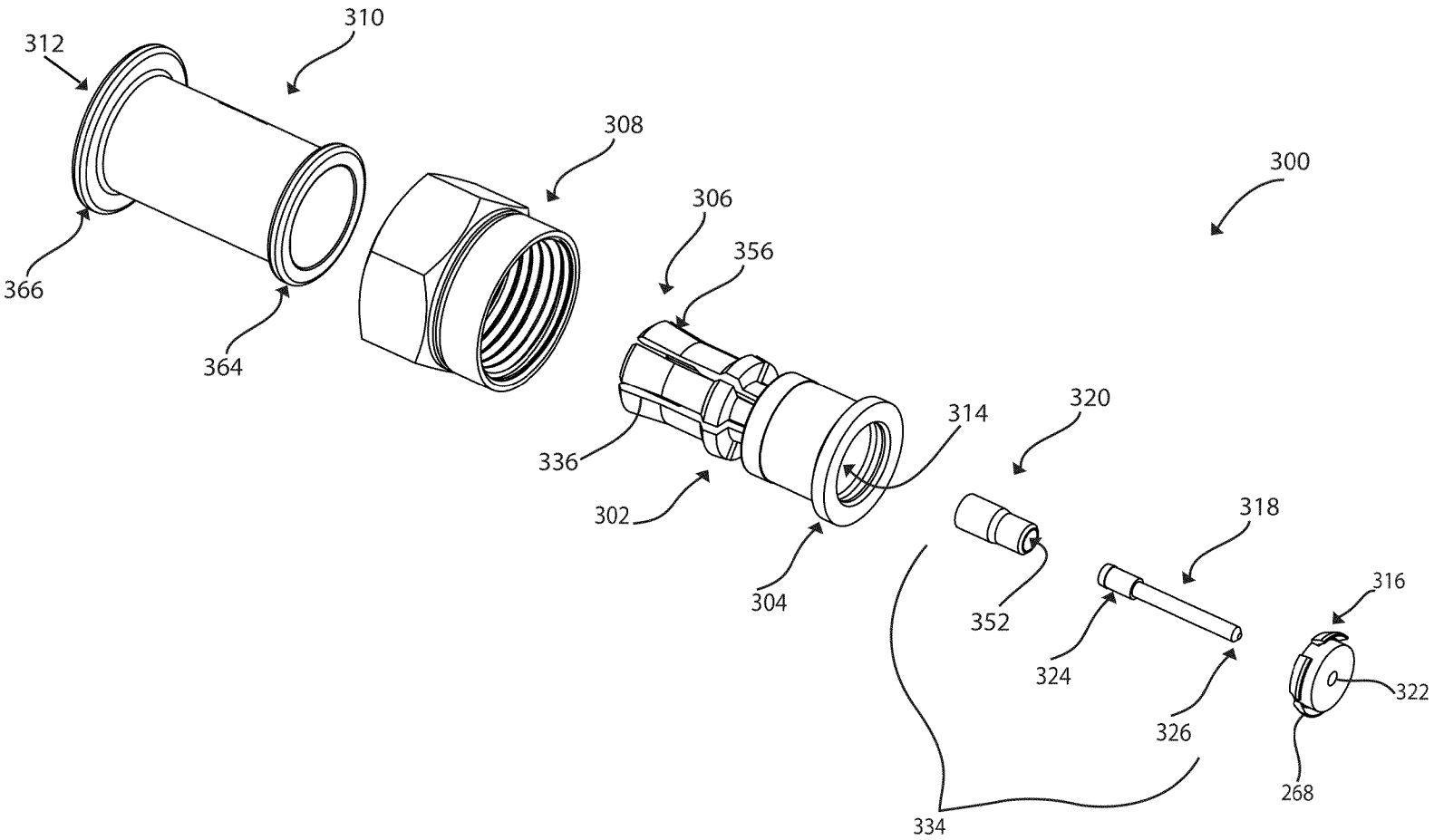
FIG. 9 depicts an exploded cross-sectional side elevation view of an embodiment of a coaxial cable connector.
Figure 10:
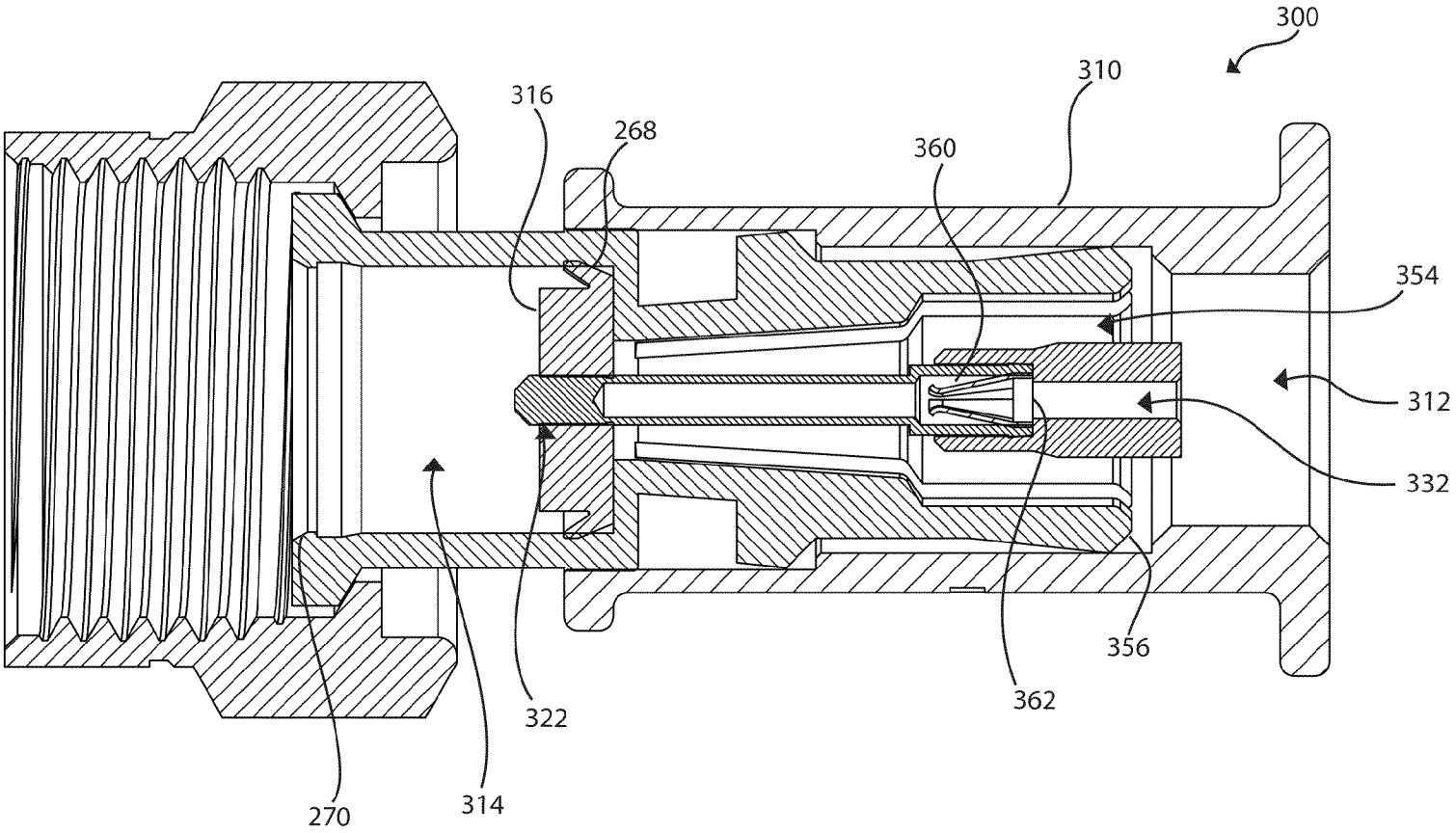
FIG. 10 depicts a cross-sectional side elevation view of the coaxial cable connector of FIG. 9.
Figure 11:
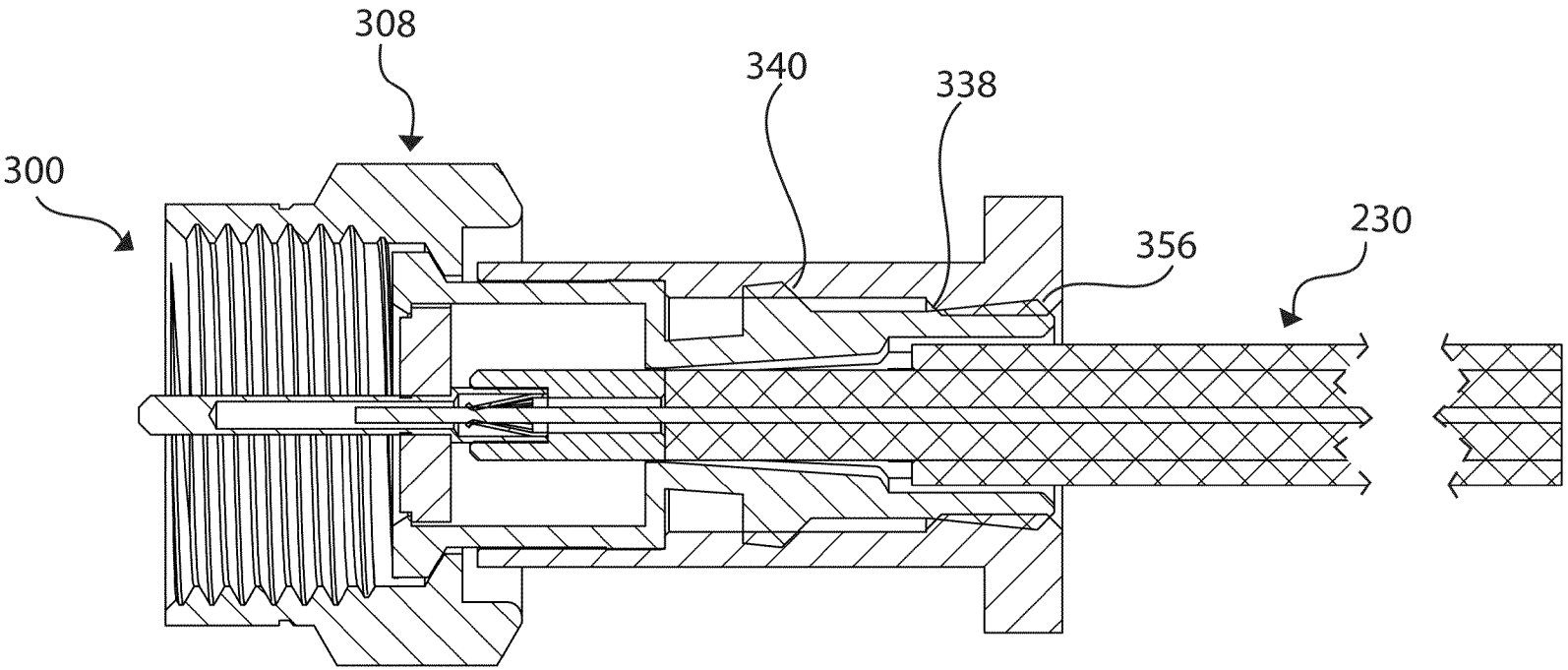
FIG. 11 depicts a cross-sectional side elevation view of the coaxial cable of FIG. 9 showing the configuration of the rearward, or clamp, section of the connector body in a compressed state.
Figure 12:
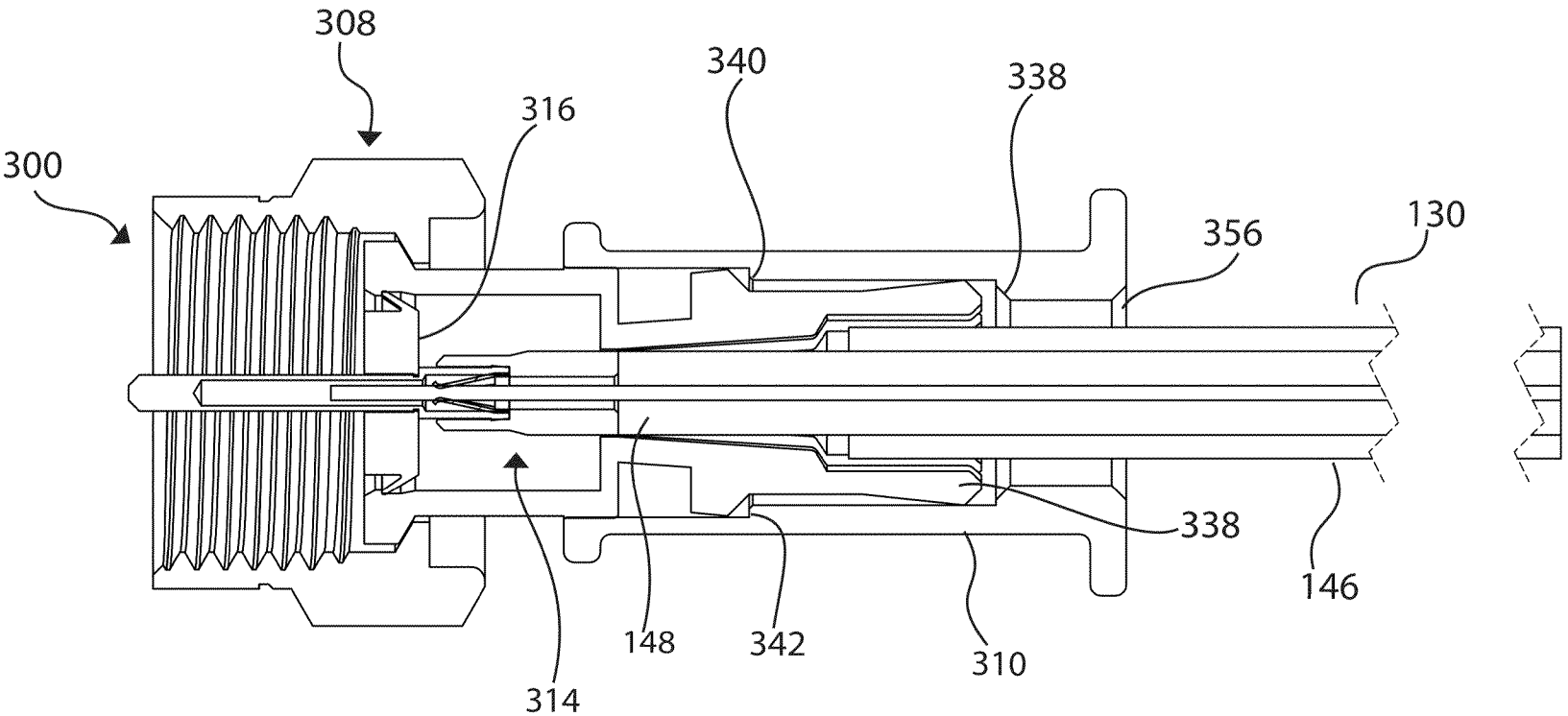
FIG. 12 depicts a cross-sectional side elevation view of the coaxial cable connector of FIG. 9 having a coaxial cable inserted and the compression cap in an uncompressed state.

Referring to the drawings, FIGS. 6-8 depict various views of an embodiment of a coaxial cable connector 200. The coaxial cable connector 200 includes a connector body 202 having a forward end 204, a rearward end 206, and a hollow cavity 214. The forward end 204 may be configured to receive an interface component, or a standard interface coupler, such as an F-type nut 208 as shown in the figures, or an IEC interface for coaxial cable. The rearward end 206 is configured for radially inward movement. The radially inward movement may be achieved in one embodiment by one or more slots 236. The coaxial cable connector 200 further includes a compression cap 210 configured to fit over the rearward end 206 of the connector body 202. The compression cap 210 includes an internal bore 212 configured to cause radially inward movement of the rearward end 206 of the connector body 202 upon axial advancement of the compression cap 210 over the rearward end 206 of the connector body 202. The compression cap 210 includes a first flange end 266. The first flange end 266 provides a substantial surface for applying axial force advance the compression cap 210 axially over the rearward end 206.

The radial inward movement is achieved in one embodiment by an inward ramp 238 located inside the internal bore 212 of the compression cap 210 and cooperating with an outward ramp 256 on the rearward end 206 of the connector body 202. In another embodiment, the radial inward movement is achieved by a compression shoulder 242 located inside the internal bore 212 of the compression cap 210 that cooperates with an outward ramp 240 at a location central to the connector body 202. In various other embodiments, there are one or more inward ramps 238 and/or compression shoulders 242 cooperating with one or more outward ramps 240, 256 and/or body shoulders (not shown) located along the internal bore 212 and the outer surface of the connector body 202 forcing the rearward end 206 to move radially inward.

The coaxial cable connector further includes a first insulator 216, a center conductor contact 218, and a second insulator 220. The first insulator 216 is configured to fit within the hollow cavity 214 of the connector body 202. In the illustrated embodiment, the first insulator 216 is a cylindrical disc. The first insulator 216 also includes a rib 268 extending about its perimeter. The rib 268 is dimensioned to contact the inner surface of the hollow cavity 216. The forward end 204 includes an inward facing lip 270 forming an opening. The inward facing lip 270 provides for the first insulator 216 to pass through the opening until the first insulator 216 is stopped by the rib 268, which is does not fit through the opening. The rib 268 is shown extending about the entire perimeter of the first insulator 216, but it may only exist along a portion of the perimeter or it may be broken along the perimeter such that two or more ribs are spaced apart along the perimeter. The first insulator 216 has a central hole 222. The center conductor contact 218 includes a socket end 224 and a pin end 226. The socket end 224 is located within the connector body 202 toward the rearward end 206. The pin end 226 passes through the central hole 222 of the first insulator 216.

The second insulator 220 defines a central passageway 232. The central passageway 232 is configured for attachment to the socket end 224 of the center conductor contact 218. In one embodiment, the second insulator 220 includes a blind bore 252 sized to receive the socket end 224 in a press-fit relationship. In various other embodiments, the socket end 224 is attached to the second insulator 220 by an adhesive or by a snap-fit arrangement or other means for attachment. In the illustrations, the second insulator 220 includes reduced diameter portion about the end of the second insulator 220 where the blind bore 252 is located. The second insulator 220 also includes slight lead-ins shown as an angled outer corner at the opening of the blind bore 252 and at the transition from the reduced diameter portion to the larger diameter portion.

The socket end 224 of the center conductor contact 218 includes a spring contact 262. The spring contact 262 has one or more spring fingers 260. The spring fingers 260 extend into the socket end 224 with an inward taper such that insertion of the center conductor 128 into the socket end 224 causes the spring fingers 260 to flex outward creating a contact force onto the center conductor 128.

The rearward end 206 of the connector body 202 defines a clamping cavity 254. The clamping cavity 254 is tapered to receive the prepared end 144 of the coaxial cable 130 as well as the full sized coaxial cable 130. Insertion of the coaxial cable 130 applies an axial force to the second insulator 220 to drive an assembly 234 of the second insulator 220 and the center conductor contact 218 forward to contact the first insulator 216 driving the assembly 234 and the first insulator 216 toward the forward end 204 of the connector body 202. The visible seating of the first insulator 216 at the forward end 204 of the connector body 202 indicates that the coaxial cable 130 is fully inserted. When the coaxial cable 130 is fully inserted, the compression cap 210 may be axially advanced toward the forward end 204 such that the rearward end 206 of the connector body 202 applies a radial force to the jacket 146 and the shield end 158. In that way, the coaxial cable 130 is secured to the compression connector 200.

Referring to the drawings, FIGS. 9-12 depict various views of an embodiment of a coaxial cable connector 300. The coaxial cable connector 300 includes a connector body 302 having a forward end 304, a rearward end 306, and a hollow cavity 314. The forward end 304 may be configured to receive an interface component, such as an F-type nut 308 as shown in the figures, or an IEC interface for coaxial cable. The rearward end 306 is configured for radially inward movement. The radially inward movement may be achieved in one embodiment by one or more slots 336. In other embodiments, the radial inward movement is achieved by selection of flexible material for the rearward end 306 and/or introduction of geometry which tends to crush or flex radially when compressed.

The coaxial cable connector 300 further includes a compression cap 310 configured to fit over the rearward end 306 of the connector body 302. The compression cap 310 includes a second flange end 364. The second flange end 364 acts to more completely fill the void at the F-type nut 308 to compression cap 310 interface. The compression cap 310 includes an internal bore 312 configured to cause radially inward movement of the rearward end 306 of the connector body 302 upon axial advancement of the compression cap 310 over the rearward end 306 of the connector body 302. The compression cap 310 includes a first flange end 366. The first flange end 366 provides a substantial surface for applying axial force advance the compression cap 310 axially over the rearward end 306.

The radial inward movement is achieved in one embodiment by an inward ramp 338 located inside the internal bore 312 of the compression cap 310 and cooperating with an outward ramp 356 on the rearward end 306 of the connector body 302. In another embodiment, the radial inward movement is achieved by a compression shoulder 342 located inside the internal bore 312 of the compression cap 310 that cooperates with an outward ramp 340 at a location central to the connector body 302. In various other embodiments, there are one or more inward ramps 338 and/or compression shoulders 342 cooperating with one or more outward ramps 340, 356 and/or body shoulders (not shown) located along the internal bore 312 and the outer surface of the connector body 302 forcing the rearward end 306 to move radially inward.

The coaxial cable connector 300 further includes a first insulator 316, a center conductor contact 318, and a second insulator 320. The first insulator 316 is configured to fit within the hollow cavity 314 of the connector body 302. In the illustrated embodiment, the first insulator 316 is a cylindrical disc. The first insulator 316 also includes an angled rib 368 formed about at least a portion of the perimeter of the cylindrical disc extending outwardly from one side toward the other. The forward end 304 includes an inward facing lip 370 forming an opening. The angled rib 368 is configured to flex radially inward as it passes the inward facing lip 370 when the first insulator 316 is pressed axially into the hollow cavity 314. The angled rib 368 flexes outward after insertion. When the first insulator 316 is installed, the inward facing lip 370 provides for the first insulator 316 to pass through the opening until the first insulator 316 is stopped by the end of the angled rib 368 contacting the inward facing lip 370.

The angled rib 368 is shown extending about the entire perimeter of the first insulator 316, but it may only exist along a portion of the perimeter or it may be broken along the perimeter such that two or more angled ribs are spaced apart along the perimeter. The angled rib 368 may also be supported by a support member extending from the outer surface of the first insulator 316 toward the inside surface of the angled rib 368. The first insulator 316 has a central hole 322. The center conductor contact 318 includes a socket end 324 and a pin end 326. The socket end 324 is located within the connector body 302 toward the rearward end 306. The pin end 326 passes through the central hole 322 of the first insulator 316.

In order to install the coaxial cable 130 into the coaxial cable connector 300, the coaxial cable 130 is prepared such that the end 144 of the coaxial cable 130 has the jacket 146, the braid and/or foil layer 150, or shield, and the dielectric 148 are removed, leaving only the center conductor 128. Another portion, the shield end 158, of the end 144 of the coaxial cable 130 is prepared by removing the jacket 146, leaving the braid and/or foil layer 150, the dielectric 148, and the center conductor 128.

The second insulator 320 is configured to receive the exposed center conductor 128 at the end 144 of a coaxial cable 130. The second insulator 320 defines a central passageway 332. The central passageway 332 is configured for attachment to the socket end 324 of the center conductor contact 318. In one embodiment, the second insulator 320 includes a blind bore 352 sized to receive the socket end 324 in a press-fit relationship. In various other embodiments, the socket end 324 is attached to the second insulator 320 by an adhesive or by a snap-fit arrangement or other means for attachment.

The socket end 324 of the center conductor contact 318 includes a spring contact 362. The spring contact 362 has one or more spring fingers 360. The spring fingers 360 extend into the socket end 324 with an inward taper such that insertion of the center conductor 128 into the socket end 324 causes the spring fingers 360 to flex outward creating a contact force onto the center conductor 128.

The rearward end 306 of the connector body 302 defines a clamping cavity 354. The clamping cavity 354 is tapered to receive the prepared end 144 of the coaxial cable 130 as well as the full sized coaxial cable 130. In the illustrated embodiment, the second insulator 320 is the same diameter as the shield end 158 of the coaxial cable 130 having the jacket 146 removed. This configuration allows for uniform contact along the coaxial cable 130 to second insulator 320 junction, but the two elements 144, 320 do not have to line up in this way. Insertion of the coaxial cable 130 applies an axial force to the second insulator 320 to drive an assembly 334 of the second insulator 320 and the center conductor contact 318 forward to contact the first insulator 316 driving the assembly 334 and the first insulator 316 toward the forward end 304 of the connector body 302. The visible seating of the first insulator 316 at the forward end 304 of the connector body 302 indicates that the coaxial cable 130 is fully inserted. When the coaxial cable 130 is fully inserted, the compression cap 310 may be axially advanced toward the forward end 304 such that the rearward end 306 of the connector body 302 applies a radial force to the jacket 146 and the shield end 158. In that way, the coaxial cable 130 is secured to the compression connector 300.

Figure 13:
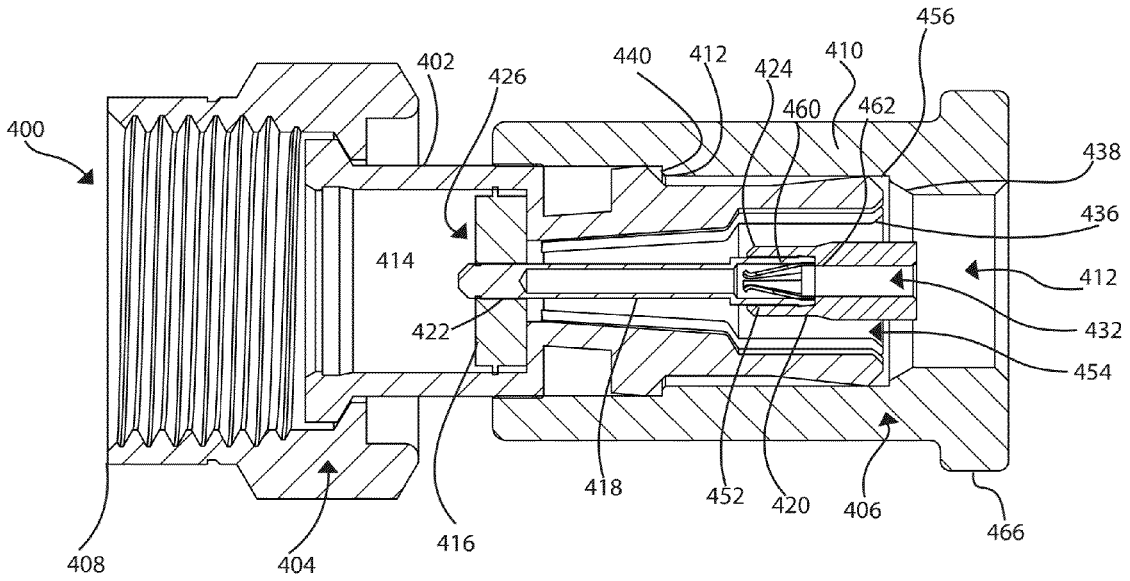
FIG. 13 depicts a hatched cross-sectional side elevation view of a coaxial cable connector comprising an embodiment of a plastic compression cap.
Figure 14:
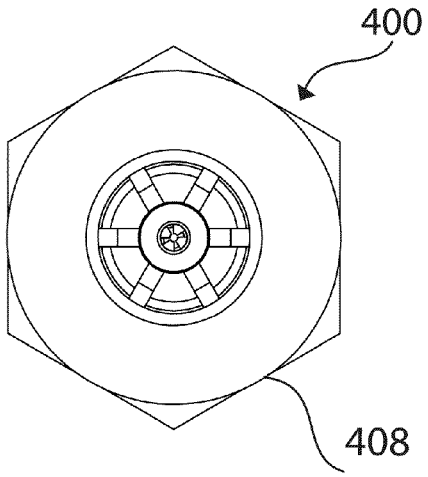
FIG. 14 depicts the rear elevation view of the connector of FIG. 13.

Referring to the drawings, FIGS. 13-14 depict various views of an embodiment of a coaxial cable connector 400.

The coaxial cable connector 400 includes a connector body 402 having a forward end 404, a rearward end 406, and a hollow cavity 414. The forward end 404 may be configured to receive an interface component, such as an F-type nut 408 as shown in the figures, or an IEC interface for coaxial cable. The rearward end 406 is configured for radially inward movement. The radially inward movement may be achieved in one embodiment by one or more slots 436. The coaxial cable connector 400 further includes a compression cap 410 configured to fit over the rearward end 406 of the connector body 402. The compression cap 410 includes an internal bore 412 configured to cause radially inward movement of the rearward end 406 of the connector body 402 upon axial advancement of the compression cap 410 over the rearward end 406 of the connector body 402. The compression cap 410 includes a first flange end 466. The first flange end 466 provides a substantial surface for applying axial force advance the compression cap 410 axially over the rearward end 406.

The radial inward movement is achieved in one embodiment by an inward ramp 438 located inside the internal bore 412 of the compression cap 410 and cooperating with an outward ramp 456 on the rearward end 406 of the connector body 402. In another embodiment, the radial inward movement is achieved by a compression shoulder 442 located inside the internal bore 412 of the compression cap 410 that cooperates with an outward ramp 440 at a location central to the connector body 402. In various other embodiments, there are one or more inward ramps 438 and/or compression shoulders 442 cooperating with one or more outward ramps 440, 456 and/or body shoulders (not shown) located along the internal bore 412 and the outer surface of the connector body 402 forcing the rearward end 406 to move radially inward.

The coaxial cable connector 400 further includes a first insulator 416, a center conductor contact 418, and a second insulator 420. The first insulator 416 is configured to fit within the hollow cavity 414 of the connector body 402. The first insulator 416 has a central hole 422. The center conductor contact 418 includes a socket end 424 and a pin end 426. The socket end 424 is located within the connector body 402 toward the rearward end 406. The pin end 426 passes through the central hole 422 of the first insulator 416.

The second insulator 420 defines a central passageway 432. The central passageway 432 is configured for attachment to the socket end 424 of the center conductor contact 418. In one embodiment, the second insulator 420 includes a blind bore 452 sized to receive the socket end 424 in a press-fit relationship. In various other embodiments, the socket end 424 is attached to the second insulator 420 by an adhesive or by a snap-fit arrangement or other means for attachment.

The socket end 424 of the center conductor contact 418 includes a spring contact 462. The spring contact 462 has one or more spring fingers 460. The spring fingers 460 extend into the socket end 424 with an inward taper such that insertion of the center conductor 128 into the socket end 424 causes the spring fingers 460 to flex outward creating a contact force onto the center conductor 128.

The rearward end 406 of the connector body 402 defines a clamping cavity 454. The clamping cavity 454 is tapered to receive the prepared end 144 of the coaxial cable 130 as well as the full sized coaxial cable 130. In the illustrated embodiment, the second insulator 420 is the same diameter as the shield end 158 of the coaxial cable 130 having the jacket 146 removed. This configuration allows for uniform contact along the coaxial cable 130 to second insulator 420 junction, but the two elements 144, 420 do not have to line up in this way. Insertion of the coaxial cable 130 applies an axial force to the second insulator 420 to drive an assembly 434 of the second insulator 420 and the center conductor contact 418 forward to contact the first insulator 416 driving the assembly 434 and the first insulator 416 toward the forward end 404 of the connector body 402. The visible seating of the first insulator 416 at the forward end 404 of the connector body 402 indicates that the coaxial cable 130 is fully inserted. When the coaxial cable 130 is fully inserted, the compression cap 410 may be axially advanced toward the forward end 404 such that the rearward end 406 of the connector body 402 applies a radial force to the jacket 146 and the shield end 158. In that way, the coaxial cable 130 is secured to the compression connector 400.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

We claim:

1. A coaxial cable connector comprising:

a connector body having a forward end, a rearward end, and a hollow cavity adjacent the forward end, the hollow cavity being a recessed region defined by an inward facing lip;

a first insulator configured to fit within the hollow cavity in such a way that the inward facing lip resists removal of the first insulator from the hollow cavity, the first insulator having a central hole;

a center conductor contact having a socket end and a pin end, the socket end located within the connector body toward the rearward end, the pin end passing through the central hole of the first insulator;

a spring contact having one or more spring fingers, the spring contact configured to fit into the socket end of the center conductor contact; and a second insulator having a central passageway configured to receive a center conductor of a coaxial cable, the second insulator having a first end and a second end, the first end adjacent the socket end of the center conductor contact, wherein an axial force applied to the second end of the second insulator drives the center conductor contact axially forward to contact the first insulator such that the axial force further drives the first insulator toward the forward end of the connector body, the first insulator being slideable within the cavity from a concealed position to an exposed position in response to the axial force applied to the second insulator so as to provide a visual cue that the center conductor of the coaxial cable is properly seated within the socket of the center conductor contact.

2. The coaxial cable connector of claim 1, further including an interface component adjacent the forward end of the connector body.

3. The coaxial cable connector of claim 1, further including a compression cap configured to fit over the rearward end of the connector body, the compression cap having an internal bore configured to cause radially inward movement of the rearward end of the connector body upon axial advancement of the compression cap over the rearward end, wherein the radial movement of the rearward end caused by axial advancement of the compression cap applies radial force to grasp the coaxial cable, attaching the coaxial cable to the compression connector.

4. The coaxial cable connector of claim 3, wherein the internal bore comprises an inward ramp configured to apply a radial force to the rearward end of the connector body upon axial advancement of the compression cap over the rearward end, wherein the rearward end moves radially inward, attaching the coaxial cable to the coaxial cable connector.

5. The coaxial cable connector of claim 3, wherein the rearward end of the connector body comprises an axial slot defining a flexible region, wherein the flexible region moves radially inward upon axial advancement of the compression cap, attaching the coaxial cable to the coaxial cable connector.

6. The coaxial cable connector of claim 1, further wherein the center conductor contact is driven forward to a stop position, the stop position being when the first insulator presses against the inward facing lip in the hollow cavity.

7. The coaxial cable connector of claim 1, wherein the second insulator includes a blind bore at the first end of the second insulator, the blind bore configured to receive the socket end of the center conductor contact.

8. The coaxial cable connector of claim 1, wherein the first insulator comprises a cylindrical disc and at least one rib extending radially from an edge of the cylindrical disc.

9. A coaxial cable connector comprising:

a connector body having a forward end, a rearward end, and a hollow cavity adjacent the forward end, the rearward end configured for radially inward movement, the connector body having a longitudinal axis;

a compression cap configured to fit over the rearward end of the connector body, the compression cap having an internal bore configured to cause radially inward movement of the rearward end of the connector body upon axial advancement of the compression cap over the rearward end;

a first insulator configured to fit within the hollow cavity of the connector body, the first insulator having a central hole;

a center conductor contact having a socket end and a pin end, the socket end located within the connector body toward the rearward end, the socket end configured to receive a center conductor of a coaxial cable, the pin end passing through the central hole of the first insulator, the center conductor contact having a common longitudinal axis with the connector body, wherein the radial movement of the rearward end caused by axial advancement of the compression cap applies radial force to the coaxial cable jacket and the shield end of the coaxial cable, securing the coaxial cable to the compression connector, and wherein an axial force, applied by a prepared end of the coaxial cable as the pin end is received within the socket, causes the first insulator to slide forwardly from a concealed position to an exposed position within the cavity so as to provide a visual cue that the center conductor of the coaxial cable is properly seated within the socket.

10. The coaxial cable connector of claim 9, further comprising a spring contact having one or more spring fingers, the spring contact configured to fit into the socket end of the center conductor contact.

11. The coaxial cable connector of claim 9, further comprising a second insulator having a first end and a second end, the first end adjacent the socket end of the center conductor contact, the second insulator having a central passageway configured to receive the center conductor of a coaxial cable, wherein the second insulator has a length that permits the center conductor to pass through the central passageway and into the socket end of the center conductor contact.

12. The coaxial cable connector of claim 11, wherein the second insulator includes a blind bore at the first end of the second insulator, the blind bore configured to receive the socket end of the center conductor contact.

13. The coaxial cable connector of claim 11, wherein the hollow cavity comprises an inward facing lip located at the forward end of the connector body.

14. The coaxial cable connector of claim 13, further wherein the center conductor contact is driven forward to a stop position, the stop position being when the first insulator presses against the inward facing lip in the hollow cavity.

15. The coaxial cable connector of claim 9, wherein the internal bore comprises an inward ramp configured to apply a radial force to the rearward end of the connector body upon axial advancement of the compression cap over the rearward end, wherein the rearward end moves radially inward, attaching the coaxial cable to the coaxial cable connector.

16. The coaxial cable connector of claim 9, wherein the rearward end of the connector body comprises an axial slot defining a flexible region, wherein the flexible region moves radially inward upon axial advancement of the compression cap, attaching the coaxial cable to the coaxial cable connector.

17. The coaxial cable connector of claim 9, wherein the first insulator comprises a cylindrical disc and at least one rib extending radially from an edge of the cylindrical disc.

18. A method of assembling a coaxial cable connector for a coaxial cable, the coaxial cable having a center conductor surrounded by a dielectric, the dielectric surrounded by a conductive grounding shield, the conductive grounding shield surrounded by a protective outer jacket, the method comprising:

inserting a first insulator into a connector body, the connector body having a forward end, a rearward end, and a hollow cavity adjacent the forward end, the hollow cavity being a recessed region defined by an inward facing lip, the first insulator configured to fit within the hollow cavity in such a way that the inward facing lip resists removal of the first insulator from the hollow cavity, the first insulator having a central hole;

inserting a center conductor contact into the first insulator, the center conductor contact having a socket end and a pin end, the socket end placed within the connector body toward the rearward end, and the pin end passing through the central hole of the first insulator;

inserting a spring contact into the center conductor contact, the spring contact having one or more spring fingers, the spring contact configured to fit into the socket end of the center conductor contact; and attaching a second insulator to the center conductor contact, the second insulator having a central passageway configured to receive a center conductor of a coaxial cable, the second insulator having a first end and a second end, the first end adjacent the socket end of the center conductor contact and configured to slideably urge the first insulator forwardly within the cavity from a concealed position to an exposed position so as to provide a visual cue that the center conductor of the coaxial cable is properly seated within the socket.

19. The method of claim 18, further including the step of sliding a compression cap over the rearward end of the connector body, the compression cap having an internal bore configured to cause radially inward movement of the rearward end of the connector body upon axial advancement of the compression cap over the rearward end.

20. A coaxial cable connector comprising:

a connector body having a cavity defined by an inward facing lip;

a first insulator defining a central hole and configured to be received within the cavity such that the inward facing lip captures the first insulator within the cavity;

a center conductor contact having socket end having one or more spring fingers and a pin end, the pin end configured to be received within the central hole of the first insulator; and a second insulator having a central passageway configured to receive a center conductor of a coaxial cable, the second insulator having a first end and a second end, the first end adjacent the socket end of the center conductor contact, wherein an axial force applied to the second end of the second insulator drives the center conductor contact axially forward to contact the first insulator such that the axial force drives the first insulator further toward the forward end of the connector body, the first insulator being slideable within the cavity from a concealed position to an exposed position in response to the axial force applied to the second insulator so as to provide a visual cue that the center conductor of the coaxial cable is properly seated within the socket of the center conductor contact.

21. The coaxial cable connector of claim 20, further including a compression cap configured to fit over a rearward end of the connector body, the compression cap having an internal bore configured to cause a radially inward movement of the rearward end of the connector body upon axial advancement of the compression cap over the rearward end, wherein the radial movement of the rearward end applies a radial force to attach the coaxial cable to the compression connector.

22. The coaxial cable connector of claim 21, wherein the internal bore comprises an inward ramp configured to apply a radial force to the rearward end of the connector body upon axial advancement of the compression cap.

23. The coaxial cable connector of claim 21, wherein the rearward end of the connector body comprises an axial slot defining a flexible region, wherein the flexible region moves radially inward upon axial advancement of the compression cap.

24. The coaxial cable connector of claim 20, wherein the center conductor contact is driven forward to a stop position, the stop position being when the first insulator presses against the inward facing lip in the hollow cavity.

* * * * *